US005251677A

United States Patent [19]

Riesen

[11] Patent Number: 5,251,677

[45] Date of Patent: Oct. 12, 1993

[54] PICKING DEVICE IN PROJECTILE LOOMS

[75] Inventor: Peter Riesen, Elgg, Switzerland

[73] Assignee: Sulzer Brothers Limited, Winterthur, Switzerland

[21] Appl. No.: 937,931

[22] Filed: Aug. 31, 1992

[30] Foreign Application Priority Data

Sep. 18, 1991 [CH] Switzerland ..... 2760/91

[51] Int. Cl.[5] ..... D03D 49/26

[52] U.S. Cl. ..... 139/439; 139/1 R; 139/449

[58] Field of Search ..... 139/1 R, 449, 438, 196.2, 139/439

[56] References Cited

U.S. PATENT DOCUMENTS

| | | | |
|---|---|---|---|
| 4,188,980 | 2/1980 | Muller | 139/1 R |
| 4,638,839 | 1/1987 | Pezzoli | 139/449 |
| 4,693,282 | 9/1987 | Campbell | 139/1 R |

FOREIGN PATENT DOCUMENTS

| | | |
|---|---|---|
| 0101777 | 3/1984 | European Pat. Off. . |
| 1801043 | 11/1969 | Fed. Rep. of Germany . |
| 1227684 | 8/1960 | France . |
| 1493881 | 9/1967 | France . |
| 7718515 | 1/1978 | France . |
| 1083279 | 9/1967 | United Kingdom . |

*Primary Examiner*—Andrew M. Falik

*Attorney, Agent, or Firm*—Townsend and Townsend Khourie and Crew

[57] ABSTRACT

The picking device in projectile looms has guide teeth (1) having narrowing zones (20, 20') adapted to receive lubricant transferred from the projectiles (100) to the guide teeth. Because of these narrowing zones and given appropriate shaping no lubricant reaches the guide teeth side surfaces which contact the warp yarns. Soiling of the cloth by lubricant can therefore be obviated. Also, adequate lubrication can be provided so that there is no soiling due to material released by abrasion between the projectile and the guide teeth.

12 Claims, 2 Drawing Sheets

PICKING DEVICE IN PROJECTILE LOOMS

BACKGROUND OF THE INVENTION

The invention relates to a picking device in projectile looms, the picking device having guide teeth for supporting and/or guiding picking projectiles. The guide teeth of the picking device can all be of identical construction and in such a case therefore have supporting and guiding surfaces. However, they can form an arrangement, for example, in which support teeth alternate with guide teeth.

The rubbing surfaces of the projectile are lubricated for abrasion protection of the guide teeth and of the projectiles (cf. e.g. EP-PS 0 101 777=T. 608). Another reason for obviating abrasion is that the material evolved in abrasion soils the finished cloth. Lubrication must therefore not be too parsimonious; however, excessive lubrication leads to soiling of the cloth by lubricant which the guide teeth scrape off from the projectile and which the warp yarns scrape off from the guide teeth. It has been found in practice that it is impossible to avoid soiling of the cloth in one way or the other. The cloth produced on a projectile loom therefore usually needs washing to remove abrasion particles or traces of lubricant or even both.

It is the object of the invention to provide means for preventing or at least reducing abrasion or lubricant soiling of the cloth during picking.

SUMMARY OF THE INVENTION

The basis of the invention is the empirically ascertained and not immediately obvious knowledge that, contrary to experience, streaks of abrasion dirt need not necessarily arise even though lubrication is parsimonious. Favorable conditions of this kind exist (if a thickly viscous oil is used sparingly as lubricant) if the guide teeth meet the following requirement: the inner edges of the support and guide surfaces forming the projectile guideway must be rounded and the radius of curvature of the edges must be 0.4±0.1 mm.

Tests made in these conditions give very satisfactory results. The film of lubricant on the projectile is maintained and is not scraped off by the guide teeth when the projectile passes through the guideway. More particularly, no lubricant reaches the side surfaces of the guide teeth, and so there is no soiling of the cloth by the lubricant. The guide teeth have lubricant only on their inside surfaces and the warp yarns do not contact the same in shed-changing.

The guide teeth for known projectile looms are punched out and deburred by treating the punched-out parts in a fluidized bed which consists of rock particles and which is maintained in vibration, the teeth edges being rounded to have radii of curvature of approximately 0.1 to 0.2 mm. These deburring procedures can be so modified for the guide teeth according to the invention that the edge radii thereof have the required value of approximately 0.4 mm. In the modified process the motion of the fluidised bed is intensified by a circulatory movement as is used in ball mills; after the mechanical treatment the tooth surfaces are smoothed by chemical polishing.

The picking device according to the invention has guide teeth having narrowing zones adapted to receive lubricant which the projectiles transfer to the guide teeth. If these narrowing zones are of appropriate shape no lubricant reaches the guide tooth side surfaces which contact the warp yarns. Soiling of the cloth by lubricant can therefore be reduced. Also, adequate lubrication can be provided and so there is no soiling of the cloth as a result of abrasion.

The invention will be described in greater detail hereinafter with reference to drawings.

DESCRIPTION OF PREFERRED EMBODIMENTS

Figure 1:
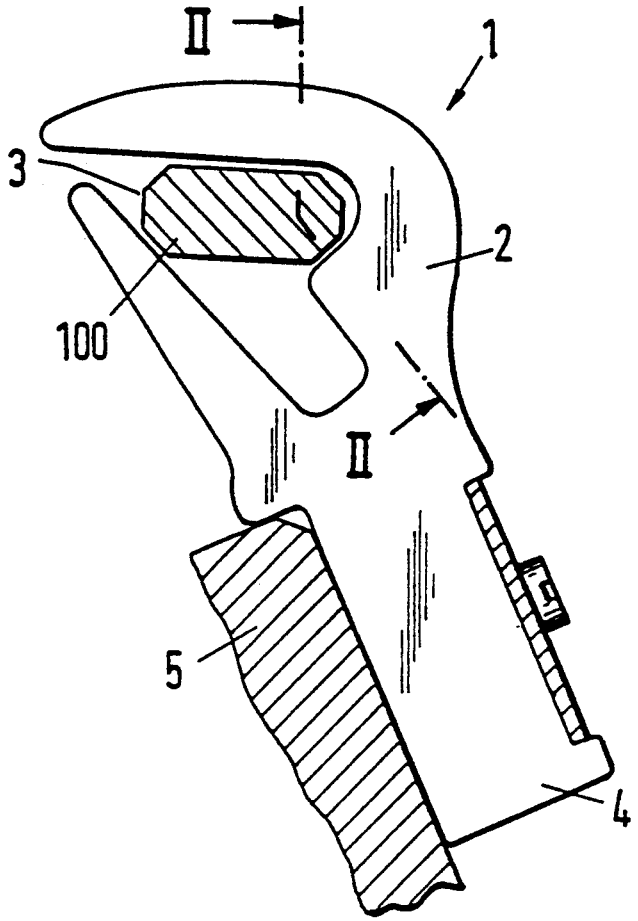
Fig. 1 PRIOR ART
FIG. 1 is a view in side elevation of a known guide tooth and shows the cross-sectional shape of the passing projectile.
Figure 2:
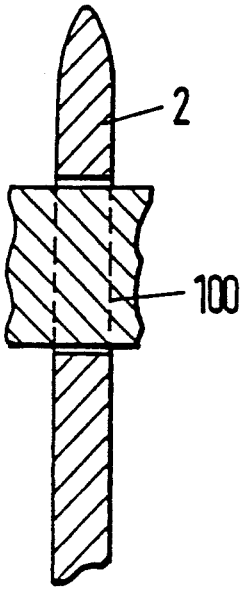
Fig. 2 PRIOR ART
FIG. 2 is a section through the guide tooth in the flight direction on the line II—II of FIG. 1.
Figure 3:
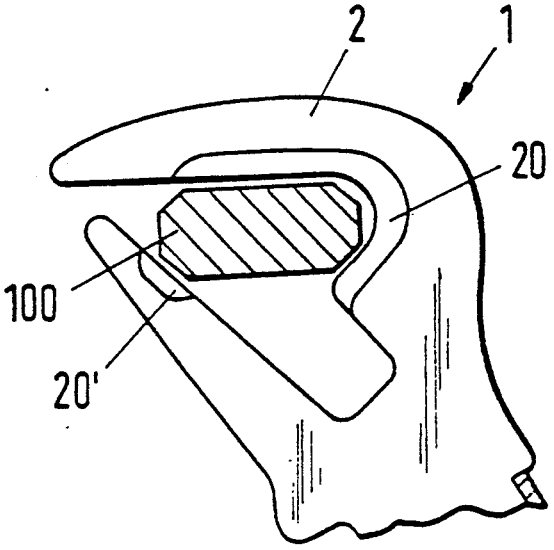
FIG. 3 shows a guide tooth according to the invention.
Figure 4:
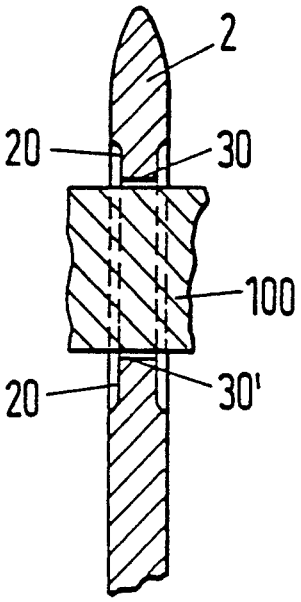
FIG. 4 is a section through the guide tooth of FIG. 3.

A guide tooth 1 shown in FIG. 1 is known, for example, from DE-PS 1 801 043 (=T.340). Its beak-like head 2 co-operates with an aperture 3 to form a segment of the guideway or flight path of a projectile 100. The base or root 4 of the tooth 1 is secured to a sley 5. FIG. 2 shows a section through the guide tooth head 2 and through the projectile 100 on the line II—II of FIG. 1. FIGS. 3 and 4 show corresponding views for a guide tooth according to the invention. Narrowing zones 20, 20' near supporting and guiding surfaces 30, 30' respectively serve to receive lubricant which the projectile 100 transfers to the guide tooth 1. This lubricant is out of range of the warp yarns (not shown) which contact the side surfaces of the head 2. The lubricant can therefore return to the surfaces 30, 30' and therefore becomes reavailable to form the lubricant film of a subsequent projectile.

Figure 5A:
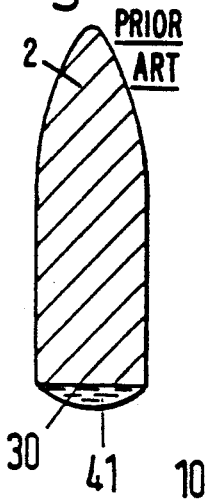
FIGS. 5*a* to 5*d* diagrammatically illustrate how the projectile scrapes lubricant off a known guide tooth.
Figure 5B:
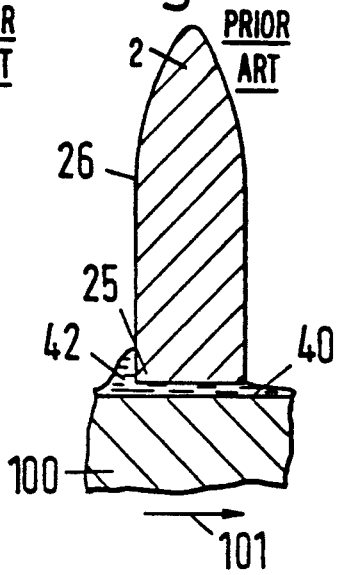
Figure 5C:
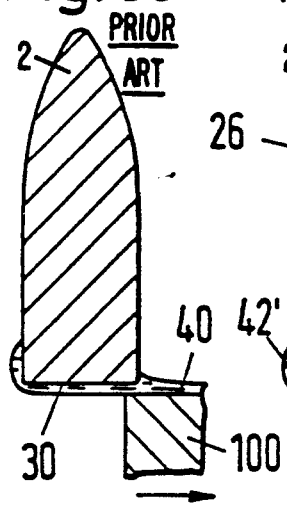
Figure 5D:
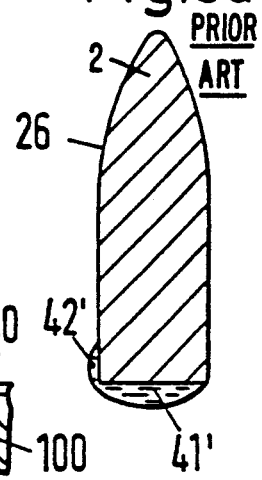
Figure 6A:
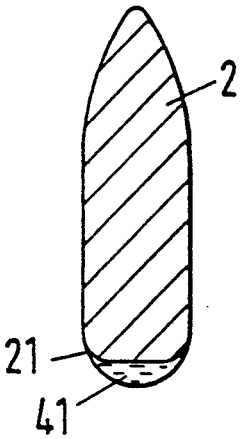
FIGS. 6*a* to 6*d* are views similar to FIGS. 5*a* to 5*d* in the case of a guide tooth according to the invention.
Figure 6B:
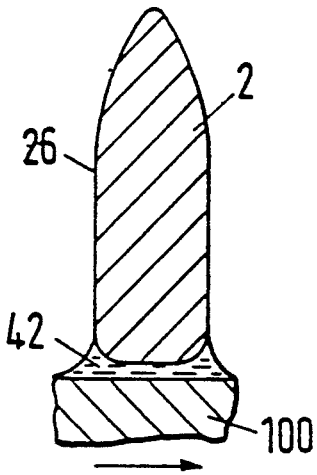
Figure 6C:
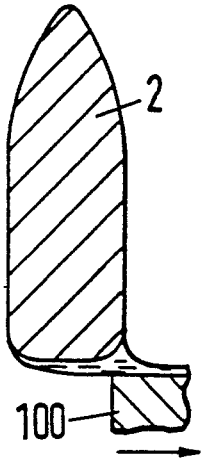
Figure 6D:
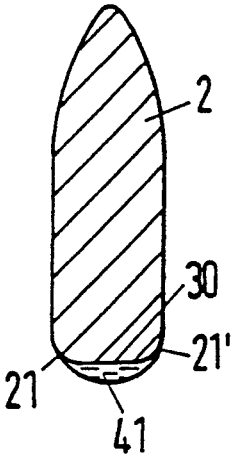

FIGS. 5*a* to 5*d* and FIGS. 6*a* to 6*d* show the circumstances concerning the lubricant film. Only the top half of the beak of the head 2 is shown in cross-section and the diagrammatically illustrated quantities of lubricant are shown to an exaggerated scale in bold print for the sake of greater clarity. FIG. 5*a* shows the lubricant 41 on the surface 30 immediately before the passage of the projectile 100. In FIG. 5*b* the projectile is making its flight (arrow 101). Lubricant film 40 of the projectile has combined with lubricant 41 of the guide tooth and is being scraped off to some extent on inside edge 25 of the entry side 26, as indicated by backed-up lubricant 42. After the passage of the projectile (FIGS. 5*c* and 5*d*) some of the backed-up lubricant discharges to the side 30 but the remainder 42' remains on the side 26 where it is subsequently scraped off by a warp yarn. FIGS. 6*a* to 6*d* show the corresponding circumstances for a guide tooth according to the invention wherein the narrowing zone 21 is embodied by a rounding of the inside edge. In this case the side surface 26 contacted by warp yarns is not wetted by backed-up lubricant 42 (FIG. 6*b*). After the passage of the projectile 100 only the surface 30 and the surfaces 21, 21' of the rounded inner edges are coated by lubricant 41.

Figure 7:
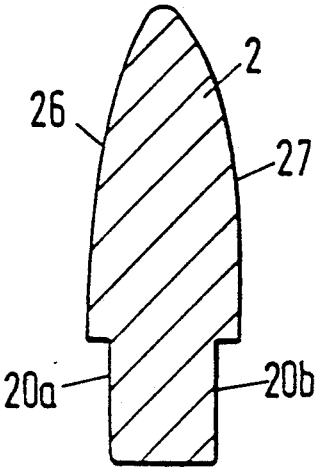
FIGS. 7–9 show cross-sectional shapes of guide teeth according to the invention.
Figure 8:
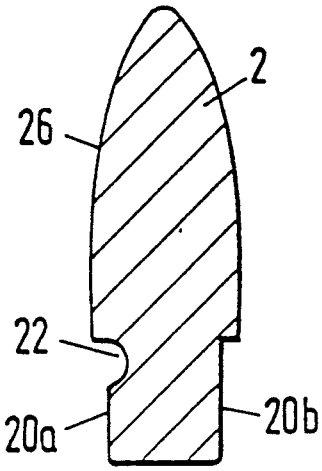
Figure 9:
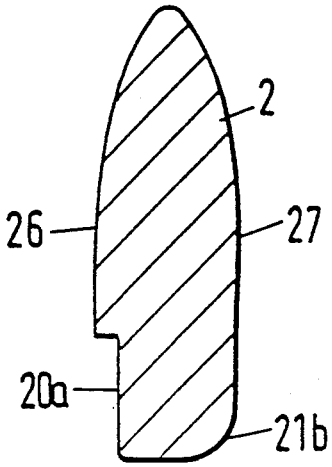

FIGS. 7–9 are cross-sectional views of various examples of how the narrowing zones of the heads 2 of guide teeth according to the invention can be devised. Preferably, this zone 20*a* on the entry side 26 is deeper than the zone 20*b* on the exit side 27 (FIG. 7). On the entry side 26, for example, a groove-like recess 22 can increase the capacity for receiving backed-up lubricant (FIG. 8). FIG. 9 shows another example wherein, as in FIGS. 7 and 8, the narrowing zones are asymmetrical of one another on the two sides, the narrowing zone 20*a* being step-like on the entry side 26 whereas on the exit side 27 the narrowing zone 21*b* is embodied by a rounding of the inside edge.

I claim:

1. A picking device in projectile looms for supporting and/or guiding picking projectiles comprising:

guide teeth including spaced apart, first and second side surfaces which are adapted to contact warp yarns, guide surfaces adapted to contact the picking projectiles and being oriented transverse to the side surfaces, and first and second narrowing zones extending from the guide surface towards the first and second side surfaces, which are adapted to receive lubricant transferred from the projectiles to the guide teeth, and at least the first narrowing zone being formed by rounded inside edges extending from the guide surface toward the first side surface.

2. A picking device according to claim 1, wherein the narrowing zones of the guide teeth are dimensioned so that a lubricant scraped off the projectiles does not contact the warp yarns.

3. A picking device according to claim 1, wherein the second narrowing zone is also formed by rounded inside edges extending from the guide surface toward the second side surface.

4. A picking device according to claim 1, wherein a radius of curvature of the inside edges in the narrowing zones is in a range of 0.3 to 0.5 mm.

5. A picking device according to claim 1 wherein the narrowing zones are embodied solely by the rounded inside edges.

6. A picking device according to claim 1, wherein the narrowing zones of the guide teeth are in symmetrical mirror-image relationship to one another on two sides of the guide teeth.

7. A picking device according to claim 1, wherein the narrowing zones of the guide teeth are asymmetrical of one another on two sides of the guide teeth and the lubricant-receiving capacity is greater on an entry side of the guide teeth than on an exit side of the guide teeth.

8. A picking device according to claim 7, wherein only the entry side has the narrowing zones.

9. A projectile loom having a picking device for supporting and/or guiding picking projectiles, the picking device comprising:

guide teeth including spaced apart, first and second side surfaces which are adapted to contact warp yarns, guide surfaces adapted to contact the picking projectiles and being oriented transverse to the side surfaces, and first and second narrowing zones extending from the guide surface towards the first and second side surfaces, which are adapted to receive lubricant transferred from the projectiles to the guide teeth, and at least the first narrowing zone being formed by rounded inside edges extending from the guide surface toward the first side surface.

10. A picking device in projectile looms for supporting and/or guide picking projectiles comprising:

guide teeth including guide teeth side surfaces which are adapted to contact warp yarns and narrowing zones which narrow at least to some extent and which are adapted to receive lubricant transferred from the projectiles to the guide teeth, the guide teeth including inside edges which are rounded in the narrowing zone and have a radius of curvature in a range of 0.3 to 0.5 mm.

11. A picking device in projectile looms for supporting and/or guiding picking projectiles comprising:

guide teeth including guide teeth side surfaces which are adapted to contact warp yarns and narrowing zones which narrow at least to some extent and which are adapted to receive lubricant transferred from the projectiles to the guide teeth, the narrowing zones being asymmetrical of one another on the two sides of the guide teeth and the lubricant-receiving capacity is greater on an entry side of the guide teeth than on an exit side of the guide teeth.

12. A picking device according to claim 11, wherein only the entry side has narrowing zones.

* * * * *